US007052475B2

(12) United States Patent
Kim

(10) Patent No.: US 7,052,475 B2
(45) Date of Patent: May 30, 2006

(54) LIE-DOWN MASSAGER

(76) Inventor: Hakjin Kim, 610 Ridgeview Ct., Diamond Bar, CA (US) 91765

( * ) Notice: Subject to any disclaimer, the term of this patent is extended or adjusted under 35 U.S.C. 154(b) by 396 days.

(21) Appl. No.: 10/617,896

(22) Filed: Jul. 11, 2003

(65) Prior Publication Data

US 2005/0010143 A1 Jan. 13, 2005

(51) Int. Cl.
*A61H 15/00* (2006.01)

(52) U.S. Cl. ..... 601/99; 601/19; 601/103; 601/116

(58) Field of Classification Search ..... 601/15, 601/17–19, 84, 86–88, 90–96, 97–99, 100–103, 601/105, 115, 116, 122, 126; 606/240–242
See application file for complete search history.

(56) References Cited

U.S. PATENT DOCUMENTS

| | | | | |
|---|---|---|---|---|
| 2,193,882 | A | 3/1940 | Petersen | |
| 2,310,106 | A | 2/1943 | Miller | |
| 2,359,933 | A | 10/1944 | Niblack | |
| 2,781,040 | A | 2/1957 | Hill | |
| 2,874,689 | A | 2/1959 | Gavelek | |
| 2,909,173 | A | 10/1959 | Anderson | |
| 3,687,133 | A | 8/1972 | Grubelic | |
| 3,877,422 | A | 4/1975 | Heuser et al. | |
| 4,190,043 | A | 2/1980 | Thompson | |
| 4,422,449 | A | 12/1983 | Hamabe | |
| 4,458,675 | A | 7/1984 | Nakao et al. | |
| 4,586,493 | A | 5/1986 | Goodman | |
| 4,656,998 | A | 4/1987 | Masuda et al. | |
| 4,899,403 | A | 2/1990 | Yamasaki | |
| 4,947,833 | A | 8/1990 | Yamasaki | |
| 5,038,757 | A | 8/1991 | Yamasaki | |
| 5,088,475 | A | 2/1992 | Steffensmeier | |
| 5,101,835 | A * | 4/1992 | DelRe | 601/122 |
| 5,165,390 | A | 11/1992 | Fleetwood | |
| 5,179,940 | A | 1/1993 | Barreiro | |
| 5,755,677 | A | 5/1998 | Masuda et al. | |
| 5,807,288 | A | 9/1998 | Wu | |
| 6,071,252 | A | 6/2000 | Marcantoni | |
| 6,190,338 | B1 | 2/2001 | Arndt | |
| 6,224,563 | B1 | 5/2001 | Nonoue et al. | |
| 6,243,609 | B1 | 6/2001 | Lee | |
| 6,409,689 | B1 | 6/2002 | Chen | |
| 6,454,732 | B1 | 9/2002 | Lee | |
| 6,542,779 | B1 | 4/2003 | Lee | |
| 6,555,798 | B1 | 4/2003 | Lee | |
| 6,591,141 | B1 * | 7/2003 | Lee | 601/19 |
| 6,629,939 | B1 | 10/2003 | Jikiba | |

(Continued)

*Primary Examiner*—Quang D. Thanh
(74) *Attorney, Agent, or Firm*—Park Law Firm; John K. Park

(57) ABSTRACT

A lie-down massager includes a base frame having an elongated top panel, through which an elongated top opening is formed centrally and lengthwise, a rider provided below the elongated top panel of the base frame, a guide member movably engaged between the base frame and the rider so as to enable the rider to make a horizontally reciprocal movement relative to the base frame, massage bumps that move vertically and/or horizontally along the elongated top opening of the elongated top panel of the base frame, and a lifter that holds the massage bumps and adjusts the height of the massage bumps. The lifter includes a hydraulic actuator that vertically moves the massage bumps, and a hydraulic controller that controls operation of the hydraulic actuator by controlling hydraulic oil flow on both sides of a plunger inside the hydraulic actuator.

20 Claims, 12 Drawing Sheets

U.S. PATENT DOCUMENTS 6,643,551 B1 11/2003 Park
6,752,772 B1 * 6/2004 Kahn ..... 601/98
6,911,012 B1 * 6/2005 Kahn ..... 601/99
2002/0138023 A1 9/2002 Kume et al.
2002/0193713 A1 12/2002 Lee
2003/0018284 A1 1/2003 Lim

* cited by examiner

LIE-DOWN MASSAGER

BACKGROUND OF THE INVENTION

The invention relates generally to a massaging device. More particularly, the present invention relates to an improved lie-down massager capable of efficiently treating bodily malfunctions such as back pain and gastrointestinal weakness by applying a therapeutic massaging treatment along the back and neck of a patient lying down on the massager whose massaging bumps move horizontally and vertically along the patient's spinal cord and neck while the vertical movement of the massaging bumps are actuated by a hydraulic lifting mechanism.

Conventional bed or mat type massaging devices employ a spring mechanism for vertically moving massaging bumps. As disclosed U.S. Pat. No. 6,454,732, a spring mechanism allows the massaging bumps to gently move up and down. However, when it comes to therapeutic effects, the spring mechanism proves too soft to push up the massaging bumps when stronger pressure is required, because tension of springs applies equally to patients lying on the massaging device regardless of patient's requirements.

A demand is to adopt a reliable mechanism demonstrating a steady and robust therapeutic effects while stabilizing the vertical movement of the massaging bumps.

SUMMARY OF THE INVENTION

The present invention is contrived to overcome the conventional disadvantages. Accordingly, an object of the invention is to provide a lie-down massager that improves therapeutic effects by adopting a hydraulic lifting mechanism for a vertical movement of massaging bumps. Another object is to stabilize the vertical movement of the massaging bumps, thereby enabling patients to receive a steady and robust massaging of the massaging bumps applied to and along their backs and necks. A further object is to improve product reliability and customer satisfaction by mechanically stabilizing the vertical movement of the massaging bumps.

To achieve these and other objects, the lie-down massager according to the present invention includes a base frame having an elongated top panel, through which an elongated top opening is formed centrally and lengthwise, a rider provided below the elongated top panel of the base frame, a guide member movably engaged between the base frame and the rider so as to enable the rider to make a horizontally reciprocal movement relative to the base frame, a lifter having a top plate and a bottom plate, a hydraulic actuator fixed to the bottom plate, and a hydraulic controller, one or more lifter guides extending downward from the top plate, one or more lifter guide bushes extending upward from bottom plate to releasably receive the lifter guides, and a plurality of massage bumps attached on the top plate of the lifter and moving vertically and/or horizontally along the elongated top opening of the elongated top panel of the base frame, and a pad covering the massage bumps and the elongated top opening of the base frame. The hydraulic controller controls operation of the hydraulic actuator. The top plate has a top upper surface portion and a top lower surface portion. The bottom plate has a bottom upper surface portion and a bottom lower surface portion. The hydraulic actuator has a hollow cylinder, a plunger reciprocating in the cylinder, and a shaft fixed to the plunger and the top plate.

In the lifter, the cylinder of the hydraulic actuator includes a upper hole positioned near one end of the hydraulic actuator that is directed toward the top plate of the lifter, and a lower hole positioned near the other end of the hydraulic actuator. The hydraulic controller supplies hydraulic fluid to the cylinder via the lower hole and recovers hydraulic fluid via the upper hole when the hydraulic actuator lifts the top plate, and the hydraulic controller supplies hydraulic fluid to the cylinder via the upper hole and recovers hydraulic fluid via the lower hole when the hydraulic actuator lowers the top plate.

The hydraulic controller includes a pump that pressurizes hydraulic fluid, and a valve assembly that selectively provides hydraulic fluid to the hydraulic actuator.

The valve assembly includes a valve chamber, a first piston, a second piston, a valve conduit and a valve rod. The first piston and the second piston are fixed to the rod and move reciprocally in the valve chamber. The valve chamber includes a first hole, a second hole, a third hole, a fourth hole, a fifth hole, a sixth hole and a first rod hole. The valve rod extends out of the valve chamber through the first rod hole. The valve conduit is positioned outside the valve chamber and connects the fifth hole and the sixth hole. The hydraulic controller further includes a first conduit that connects the first hole of the valve chamber and the upper hole of the hydraulic actuator, a second conduit that connects the pump and the second hole of the valve chamber, a third conduit that connects the third hole of the valve chamber and the lower hole of the hydraulic actuator, a fourth conduit that connects the fourth hole and the pump.

When the top plate is lifted, the first piston and the second piston are moved to a lifting position in which the first piston and the second piston partition the valve chamber such that hydraulic fluid flows from the pump to the lower hole of the hydraulic actuator via the second conduit and the third conduit so that the plunger is pushed upward, and hydraulic fluid flows from the upper hole of the hydraulic actuator to the pump via the first conduit, the valve conduit, and the fourth conduit so that hydraulic fluid is recovered.

When the top plate is lowered, the first piston and the second piston are moved to a lowering position in which the first piston and the second piston partition the valve chamber such that hydraulic fluid flows from the pump to the upper hole of the hydraulic actuator via the first conduit and the second conduit so that the plunger is pushed downward, and hydraulic fluid flows from the lower hole of the hydraulic actuator to the pump via the third conduit and the fourth conduit so that hydraulic fluid is recovered.

When the top plate is neither lifted nor lowered, the first piston and the second piston are moved a neutral position in which the first piston and the second piston block the first hole and the third hole such that hydraulic fluid flow between the hydraulic controller and the hydraulic actuator does not occur.

The hydraulic controller further includes a hydraulic fluid accumulator between the pump and the valve assembly. The hydraulic fluid accumulator stores pressurized hydraulic fluid.

The hydraulic controller further includes a first solenoid that applies force to move the valve rod of the valve assembly into or out of the valve chamber such that the first piston and the second piston are moved to the lifting position or the lowering position, and a first spring fixed between the solenoid and the valve chamber to return the first piston and the second piston to the neutral position when no force is applied by the first solenoid. A second solenoid may be provided at a position opposite to the first solenoid.

The hydraulic controller further includes a link connected between the valve rod and the solenoid. The link reverses direction of movement of the first solenoid, and the first spring is fixed between the valve chamber and the link.

The massage bumps are partitioned to first and second pairs, and the first pair bumps are aligned parallel to the second pair bumps. The massage bump includes a heater that is a heating lamp generating heat and infrared rays.

First and second bump holders are provided for propping and maintaining the first and second pair bumps above the top portion of the lifter. The first and second bump holders are tapered toward each lower end thereof. Also a first engagement member to rockingly engage the lower ends of the bump holders to the top portion of the lifter, and a second engagement member to rollingly engage the massage bumps thereto are provided. The massage bumps are roller balls that are formed of jade.

Alternatively, the massage bumps are provided as round projections that are fixed to the top upper surface portion of the lifter.

The guide member includes one or more roller gear engaged to and powered by a roller gear motor, and one or more side rack gears parallel to each other and provided lengthwise in the base frame. The roller gear motor is fixed to the rider, and the roller gears are rollably connected to the rider and rotatably mounted on the side rack gears.

Alternatively, the guide member includes rider guide rollers provided on each side of the rider, and a pair of pulleys linked by a rope and respectively mounted in a front end portion and a rear end portion of the base frame. The rider guide rollers are rollably engaged to the base frame to guide a horizontally reciprocal movement of the rider. A predetermined portion of the rope is fixedly attached to the rider so that the pulley rotation enables the rider to generate a horizontally reciprocal movement of the rider. The pulleys are relatively twisted by 90 degrees against each other.

The lie-down massager further includes a pair of roller coasters parallel to each other, and coaster guide rollers formed outwardly extending from each side of the lifter. The roller coasters are attached to the base frame, and each of the roller coasters has a substantially waved top surface. The coaster guide rollers enable the coasting member to make a roller coasting movement on and along the waved top surfaces of the roller coasters. Each of the waved top surfaces of the roller coasters substantially forms a curvature of a human spinal cord.

The bottom plate of the lifter further includes a plurality of elongated guides extending downward from the bottom portion, and the rider further has a plurality of guide bushes upwardly formed on the rider to releasably receive the elongated guides so as to stabilize the roller coasting movement of the lifter along the roller coasters. The elongated guides are shaped in pins.

Advantages of the present inventions include that: (1) the hydraulic lifting mechanism minimizes parts required for the vertical movement of the massaging, while improving stability in the vertical reciprocation of the lifter carrying the massaging bumps; (2) the hydraulic lifting mechanism provides smooth and quite operation of the lifter; and (3) the coasting member working with the roller coasters to realize an additional lifting by utilizing the horizontally reciprocal movement of the rider enables the massaging bumps to continue a smooth, steady and robust massaging on the patient, thereby substantially improving massaging effect and subsequently maximizing customer satisfaction.

Although the present invention is briefly summarized, the full understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
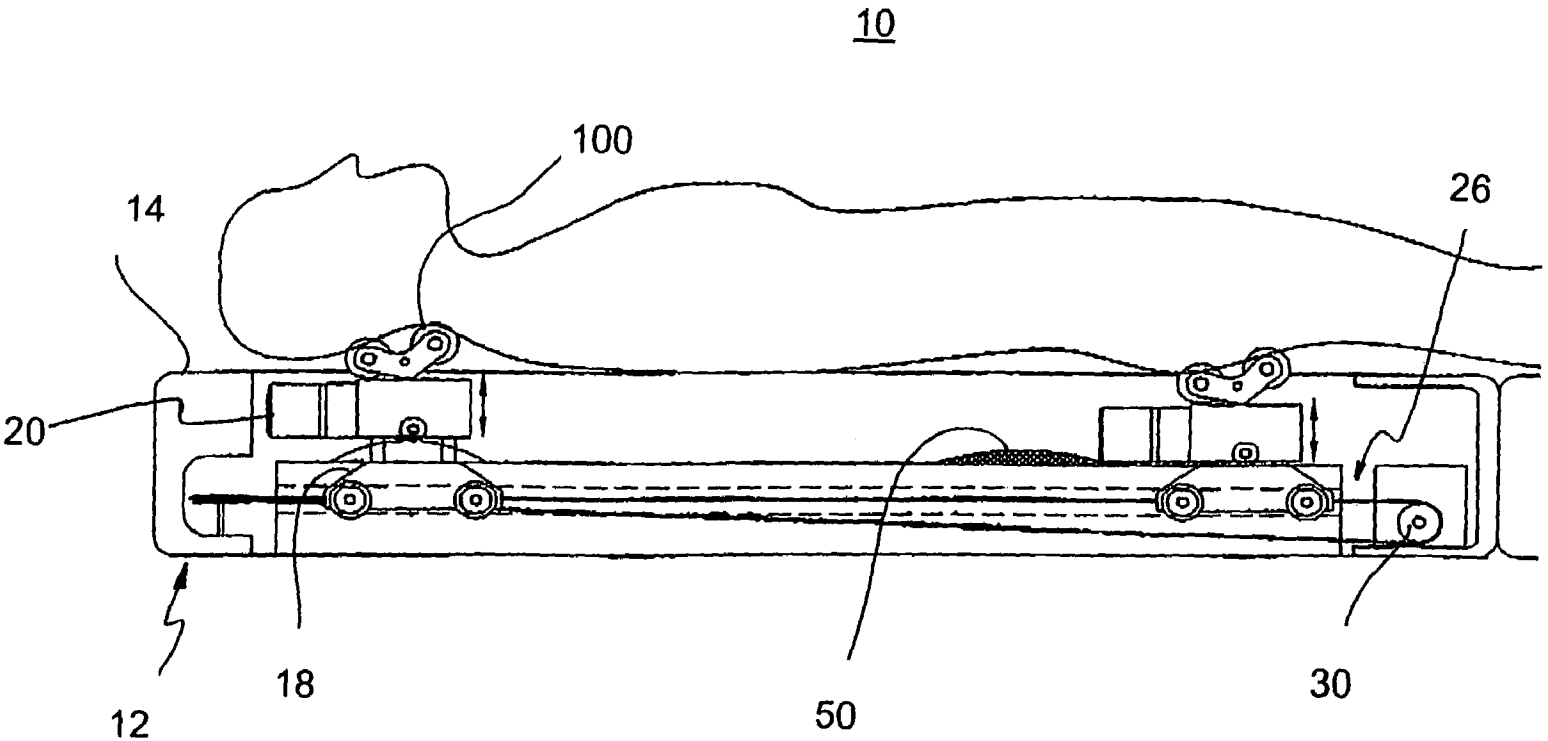
FIG. 1 is a view showing a lie-down massager with a patient lying thereon according to the present invention.
Figure 2:
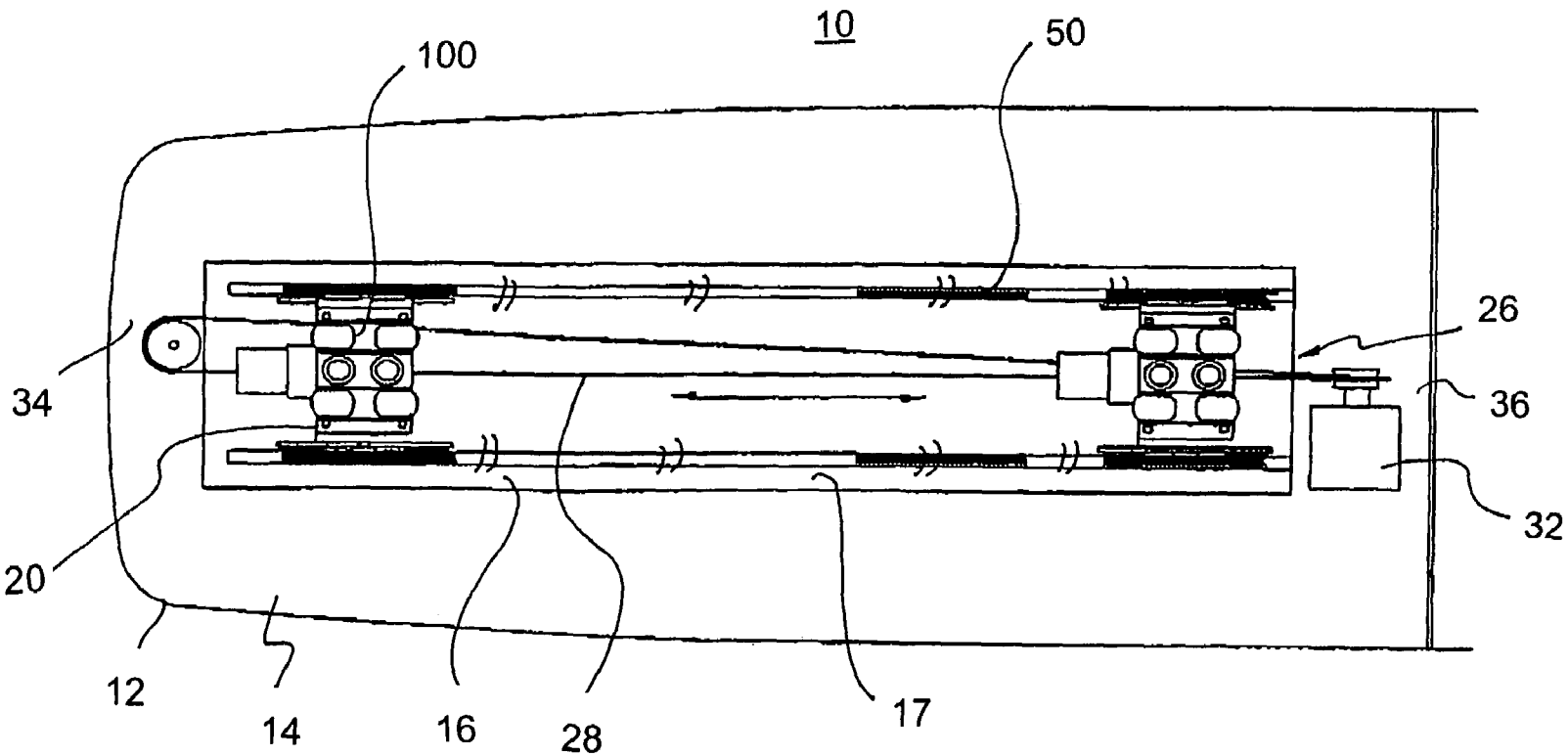
FIG. 2 is a plan view showing the lie-down massager without the patient in FIG. 1.

FIG. 1 shows a brief massaging mechanism of a lie-down massager 10 according to the present invention with a patient lying thereon for a bodily massage, and FIG. 2 shows a plan view of the massager 10 excluding the patient. As shown therein, the lie-down massager 10 includes a base frame 12 in a bed type or a mat type. The base frame 12 includes an elongated top panel 14, and an elongated opening 16 is formed centrally and lengthwise through the elongated top panel 14. The massager 10 includes a rider 18 and a lifter 20. The rider 18 is provided below the elongated top panel 14 of the base frame 12.

In order to implement the horizontal reciprocation of the rider 18, there is provided a guide member 26 movably engaged between the base frame 12 and the rider 18 so as to enable the rider 18 to make a horizontally reciprocal movement relative to the base frame 12. Here, it is recommended that the guide member 26 be either a rope-pulley application or a rack gear application.

Figure 3:
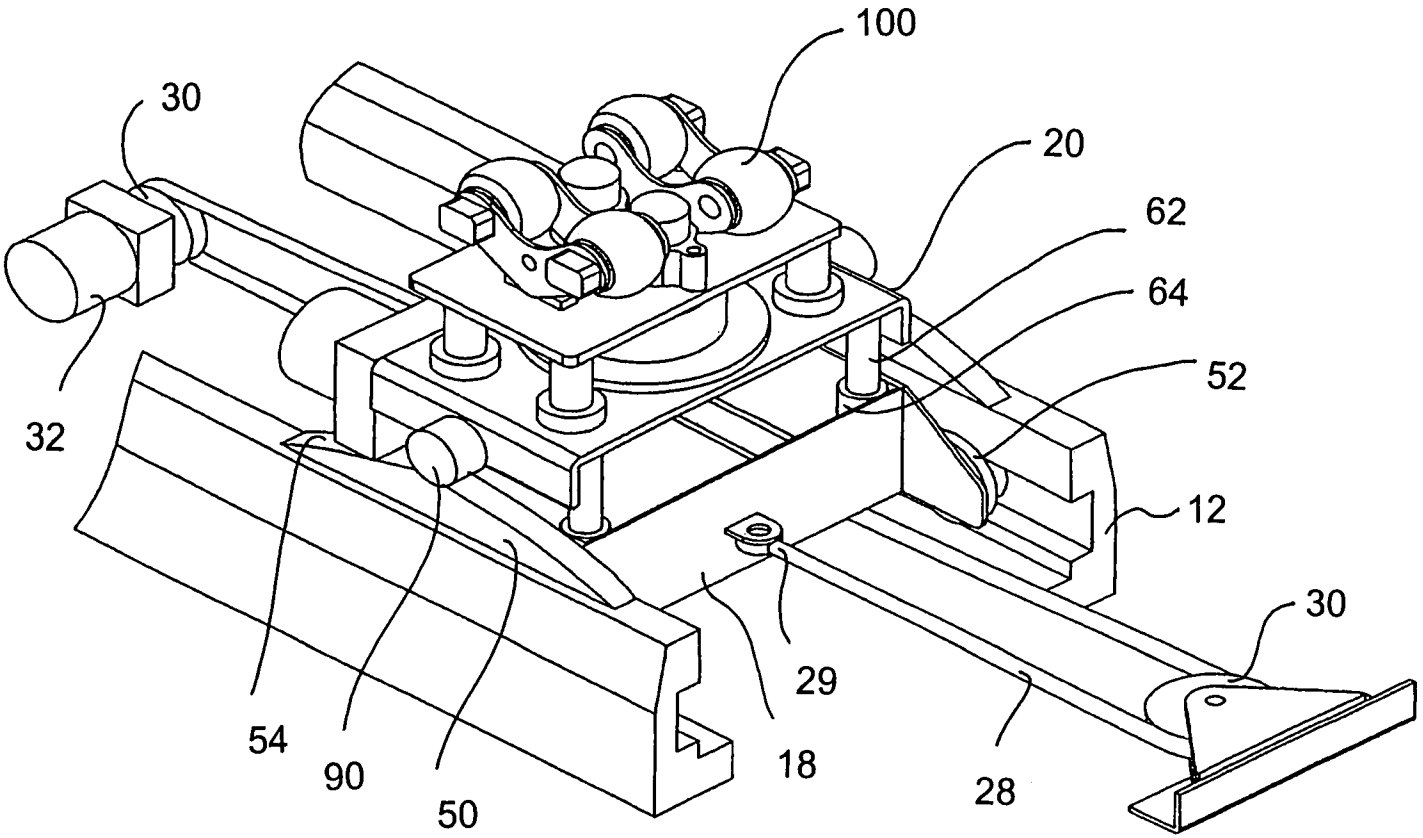
FIG. 3 is a partial perspective view showing an overall mechanism of the lie-down massager according to a first embodiment of the present invention.

As shown in FIG. 2 together with FIG. 3, the guide member 26 according to the rope-pulley application includes a rope 28, a pair of pulleys 30 and a pulley motor 32 that controls one of the pulleys 30. The pulleys 30 are linked by the rope 28 and respectively mounted in a front end portion 34 and a rear end portion 36 of the base frame 12. In a preferred version, the pulley motor 32 is provided adjacent to the pulley 30 provided in the rear end portion 36 of the base frame 12. In this construction, a predetermined portion 29 of the rope 28 is fixedly attached to the rider 18 so that the pulley rotation enables the rider 18 to generate a horizontally reciprocal movement of the rider 18. Preferably, the pulleys 30 are relatively twisted by 90 degrees against each other to facilitate the horizontal reciprocation of the rider 18 while improving controllability of the rider reciprocation.

Figure 4:
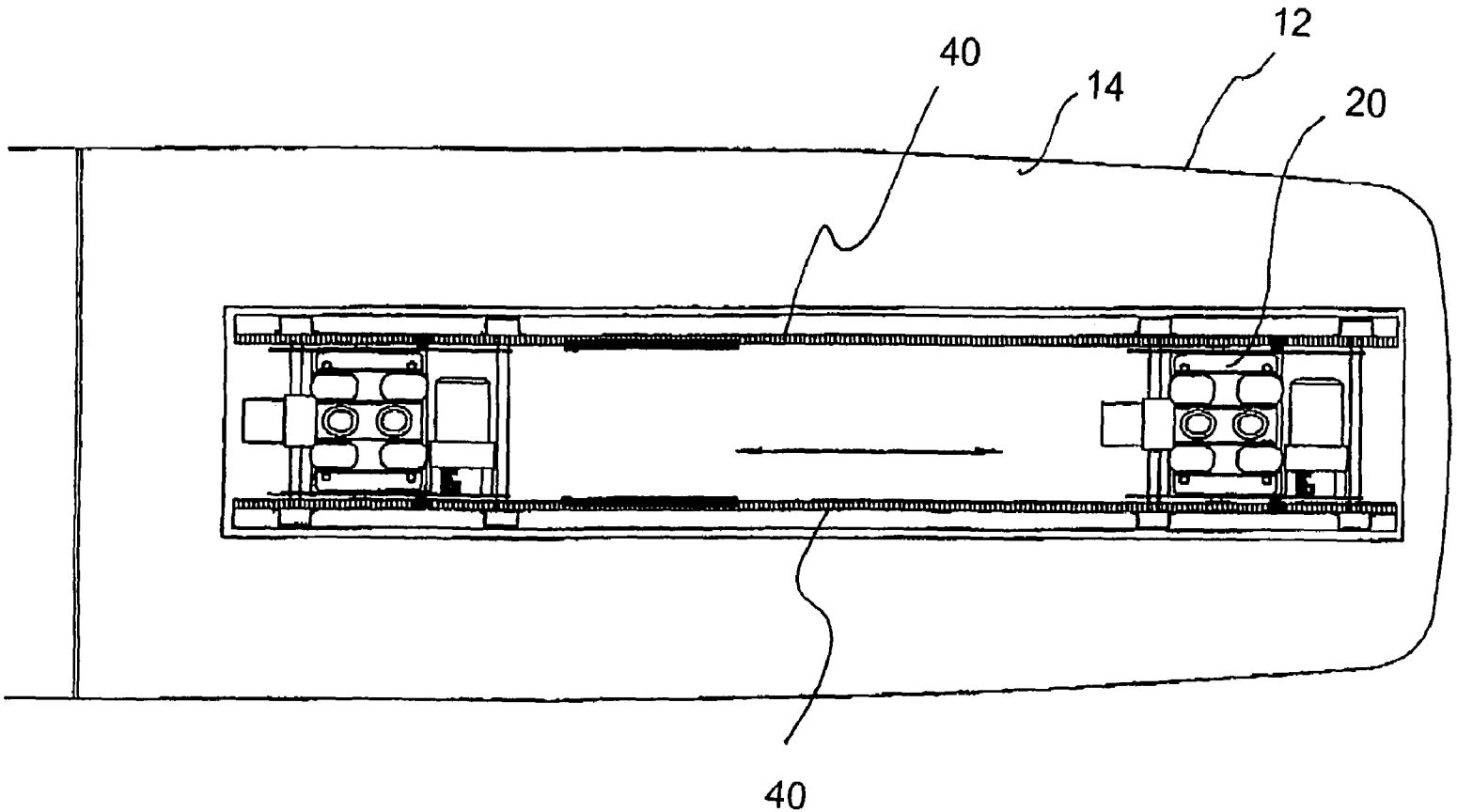
FIG. 4 is a partial plan view showing a second embodiment of the present invention.
Figure 5:
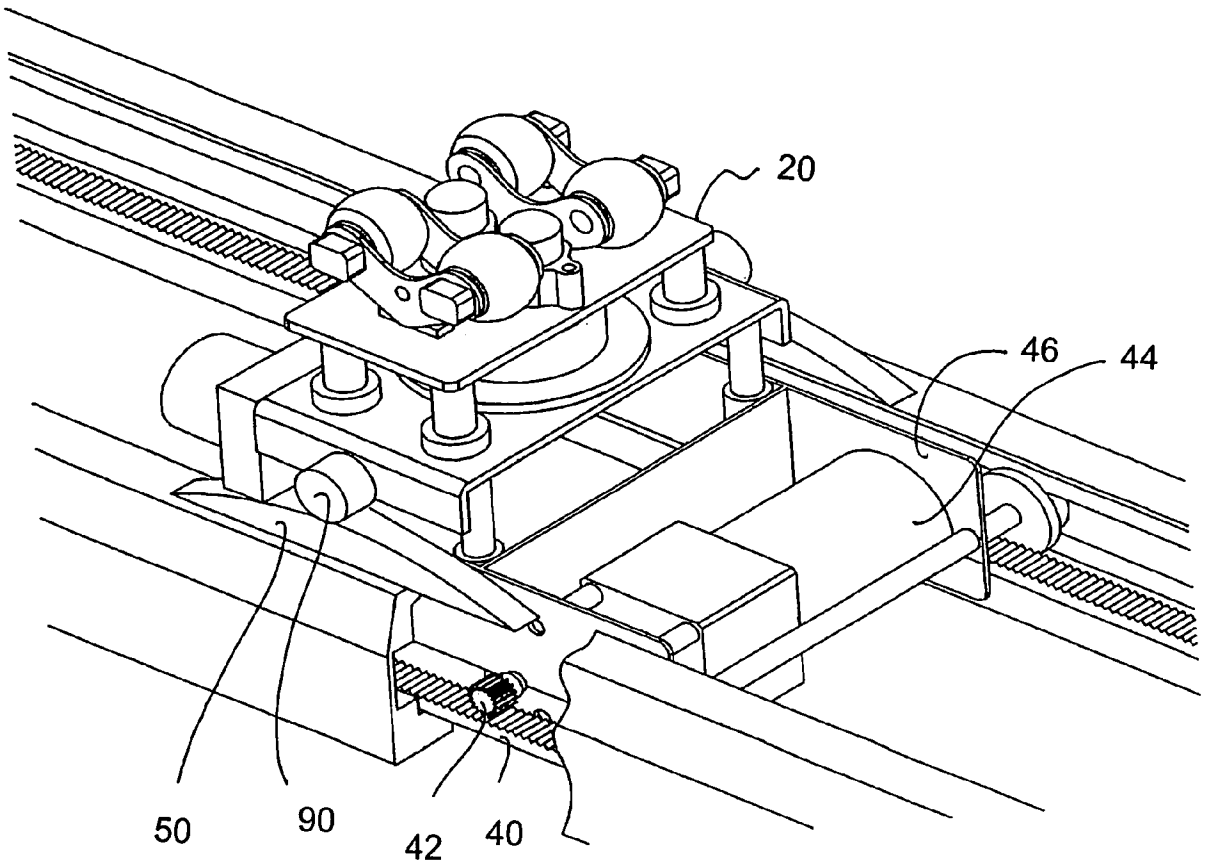
FIG. 5 is a partial perspective view showing the mechanism according to the second embodiment of the present invention.
Figure 6:
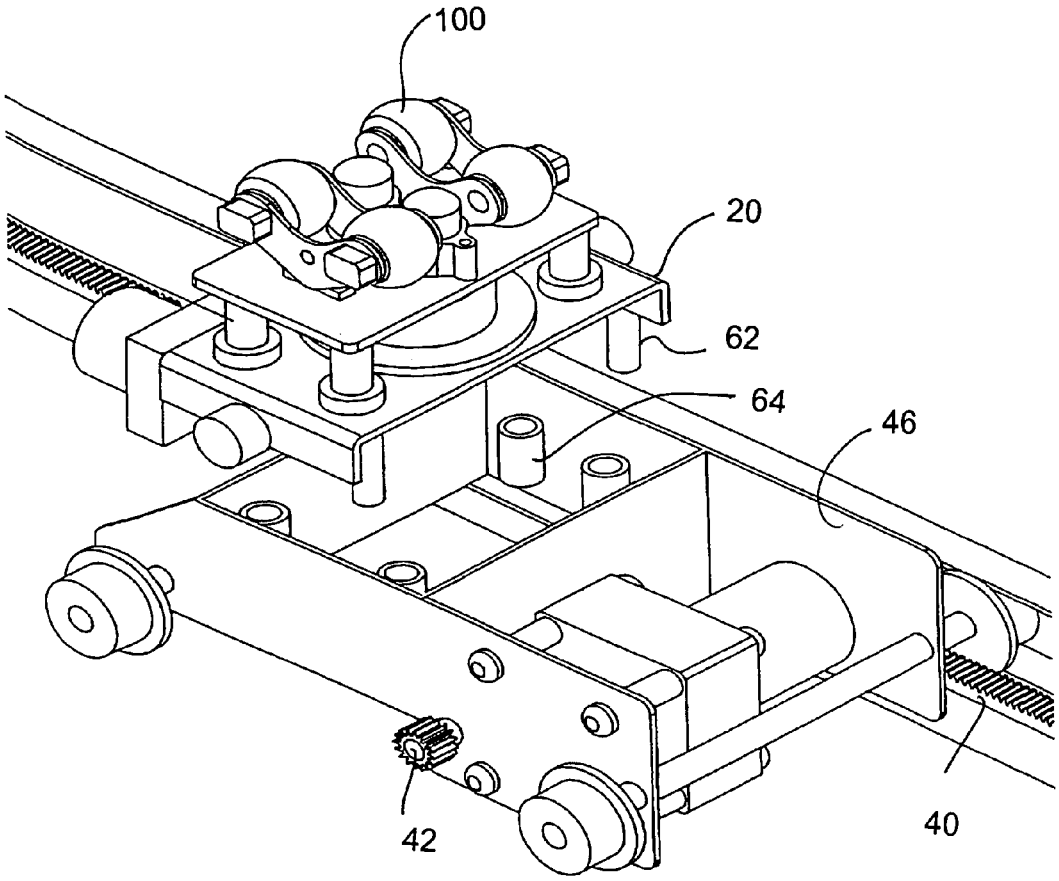
FIG. 6 is a partial exploded perspective view showing the rider and the lifter.
Figure 7:
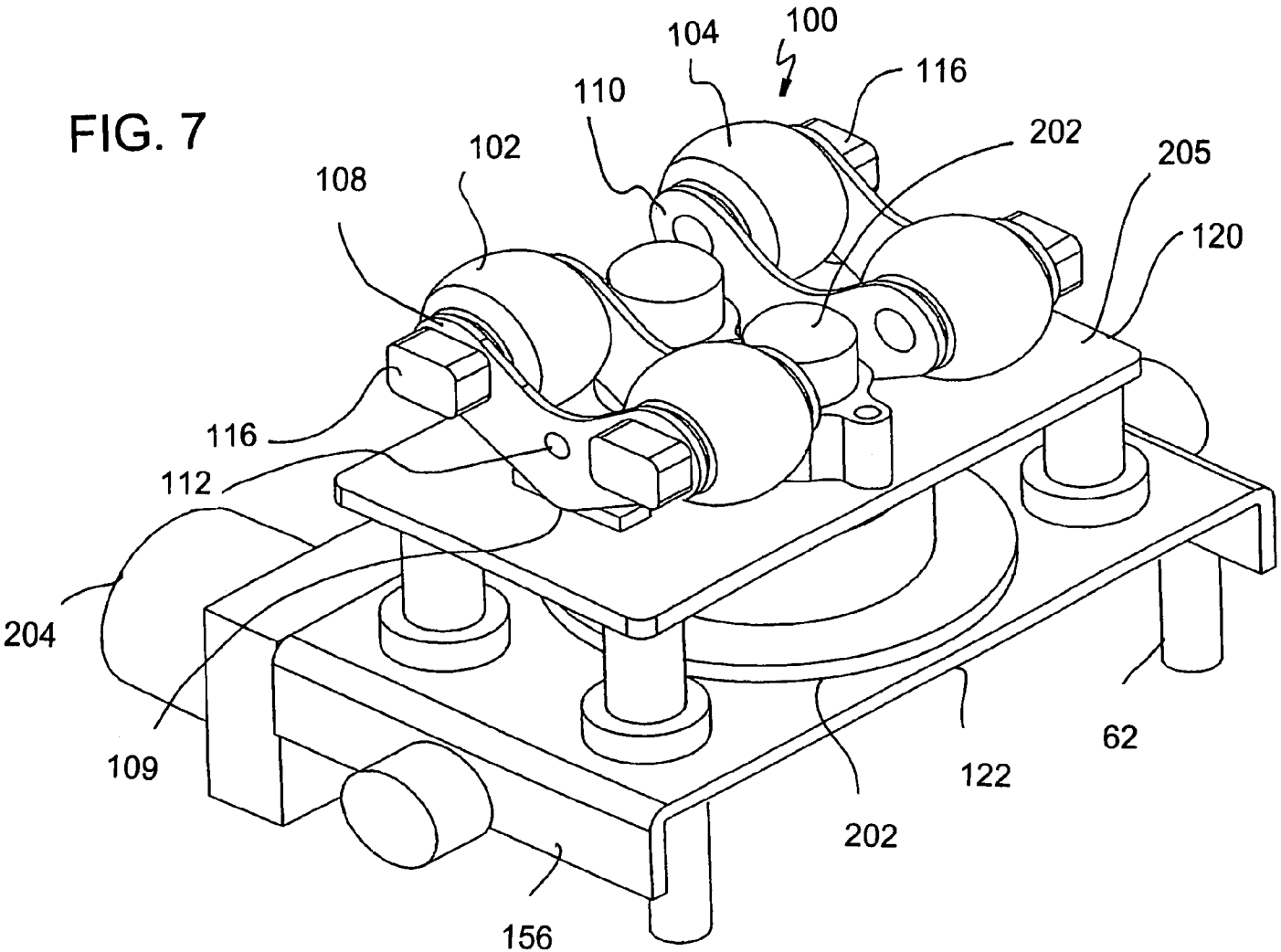
FIG. 7 is a perspective view of the lifter showing the operation of the hydraulic lifting mechanism.

Meanwhile, FIGS. 4, 5 and 6 respectively illustrate the rack gear application for the horizontal reciprocation of the rider 18. As shown therein, the guide member 26 employing the rack gear application includes a pair of side rack gears 40 parallel to each other and lengthwisely provided in the base frame 12, a roller gear 42 perpendicular to the side rack gears 40, and a roller gear motor 44 fixed to the rider to power the roller gear 42. The roller gear 42 is rollably connected to a rider 46 and rotatably mounted on the side rack gears 40.

To accelerate massaging effect, the massager 10 includes one or more pairs of roller coasters 50 parallel to each other. The roller coasters 50 are attached to the base frame 12 and above the rider guide rollers 52 formed on each side of the rider 18 (refer to FIG. 3). The rider guide rollers 52 are rollably engaged to the base frame 12 to guide a horizontally reciprocal movement of the rider 18. That is, the roller coasters 50 are formed on each side of the base frame 12. Here, the roller coasters 50 each have a substantially waved top surface 54. It is preferred that the waved top surfaces 54 of the roller coasters 50 each substantially form a curvature of a human spinal cord.

In order to utilize the roller coasters 50, there are provided two coaster guide rollers 90 formed outwardly extending from each side of the lifter 20. The coaster guide rollers 90 enable the lifter 20 to make a roller coasting movement on and along the waved top surfaces 54 of the roller coasters 50.

As shown in FIGS. 7–12, the lifter 20 has a top plate 120 and a bottom plate 122, a hydraulic actuator 202 fixed to the bottom plate 122, and a hydraulic controller 204.

Figure 8:
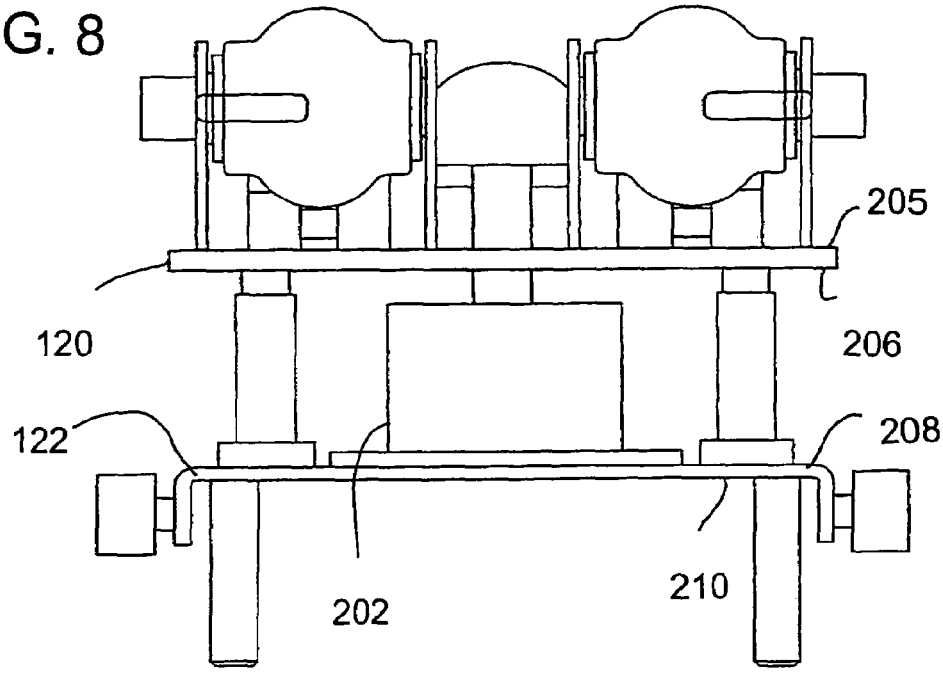
FIG. 8 is a front elevation view showing that the lifter is in its lowest position.
Figure 9:
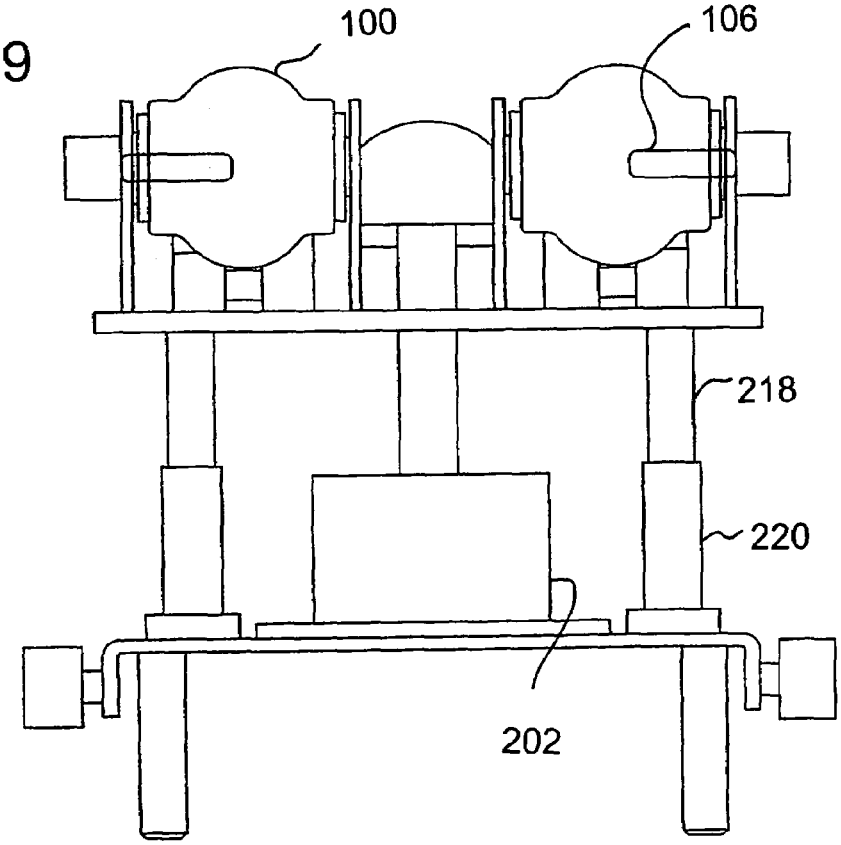
FIG. 9 is a front elevation view showing that the lifter is in its highest position.
Figure 10:
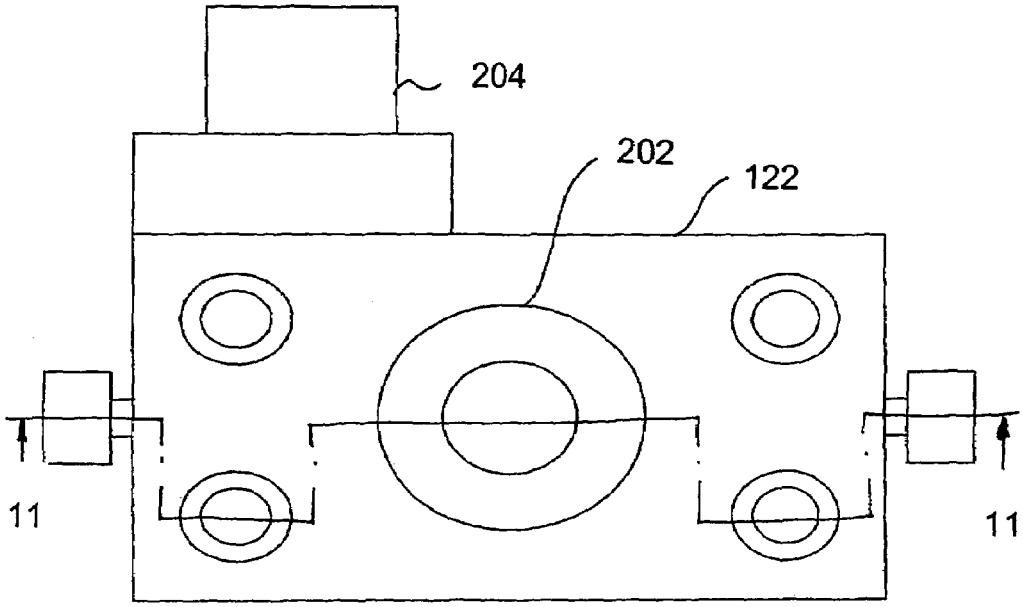
FIG. 10 is a plan view of the lifter.

The hydraulic controller 204 controls operation of the hydraulic actuator 202. As shown in FIGS. 8 and 9, the top plate 120 has a top upper surface portion 205 and a top lower surface portion 206. The bottom plate 122 has a bottom upper surface portion 208 and a bottom lower surface portion 210.

Figure 11:
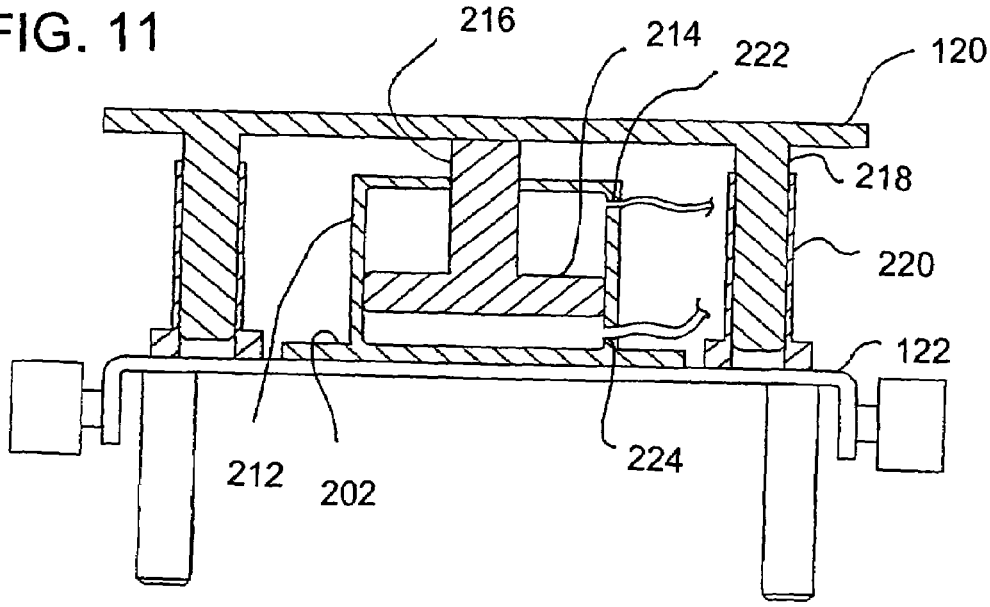
FIG. 11 a cross-sectional view of the lifter taken along the line 11—11 of FIG. 10.

As shown in FIG. 11, the hydraulic actuator 202 has a hollow cylinder 212, a plunger 214 reciprocating in the cylinder 212, and a shaft 216 fixed to the plunger 214 and the top plate 120.

Four lifter guides 218 extend downward from the top lower surface portion 206 of the top plate 120 at the four corners of the top plate 120. Four lifter guide bushes 220 extend upward from the bottom upper surface portion 208 of the bottom plate 122 to releasably receive the lifter guides 218.

The cylinder 212 includes an upper hole 222 positioned near one end of the hydraulic actuator 202 that is directed toward the top plate 120, and a lower hole 224 positioned near the other end of the hydraulic actuator 202. When the hydraulic actuator 202 lifts the top plate 120, the hydraulic controller 204 supplies hydraulic fluid to the cylinder 212 via the lower hole 224 and recovers hydraulic fluid via the upper hole 222. When the hydraulic actuator 202 lowers the top plate 120, the hydraulic controller 204 supplies hydraulic fluid to the cylinder 212 via the upper hole 222 and recovers hydraulic fluid via the lower hole 224.

Figure 13:
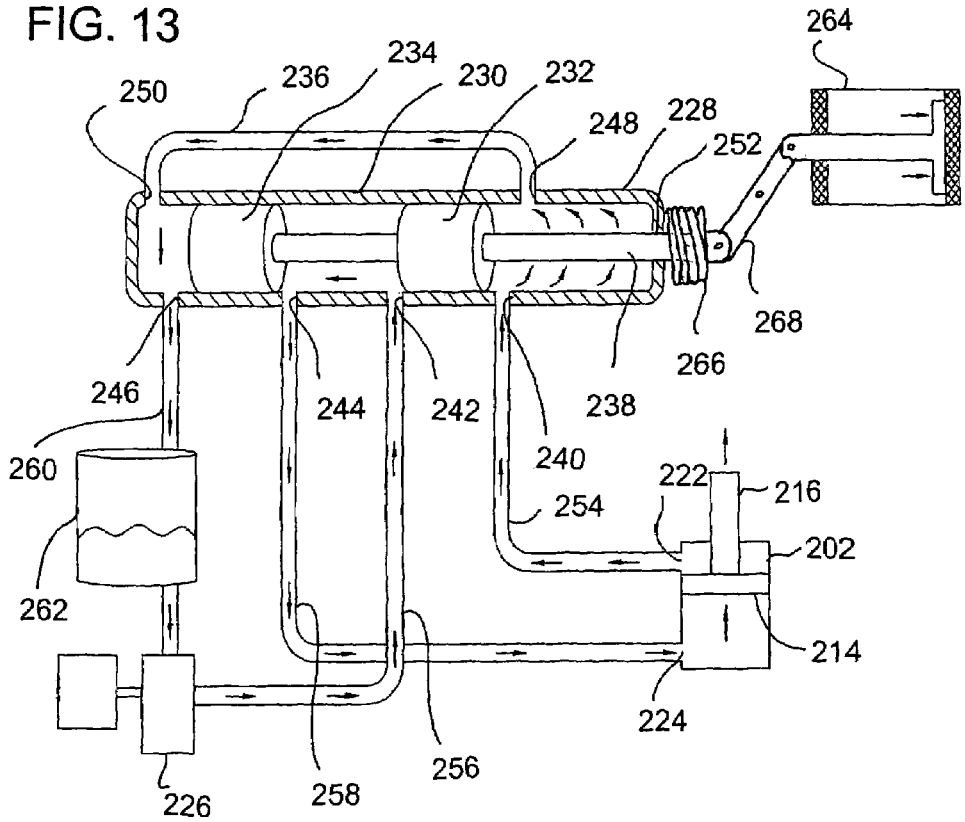
FIG. 13 is a schematic cross-sectional view showing a hydraulic controller that is operating to lift the massage bumps on the lifter.
Figure 14:
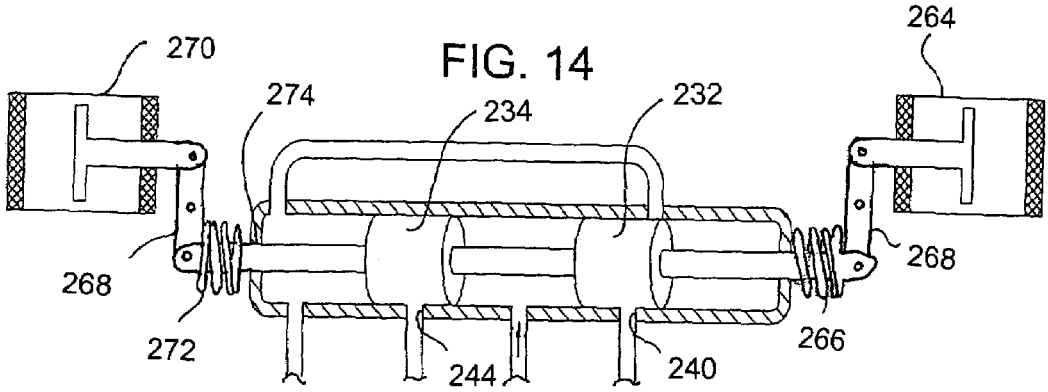
FIG. 14 is a schematic cross-sectional view showing the hydraulic controller that is operating to stop the vertical motion of the massage bumps.
Figure 15:
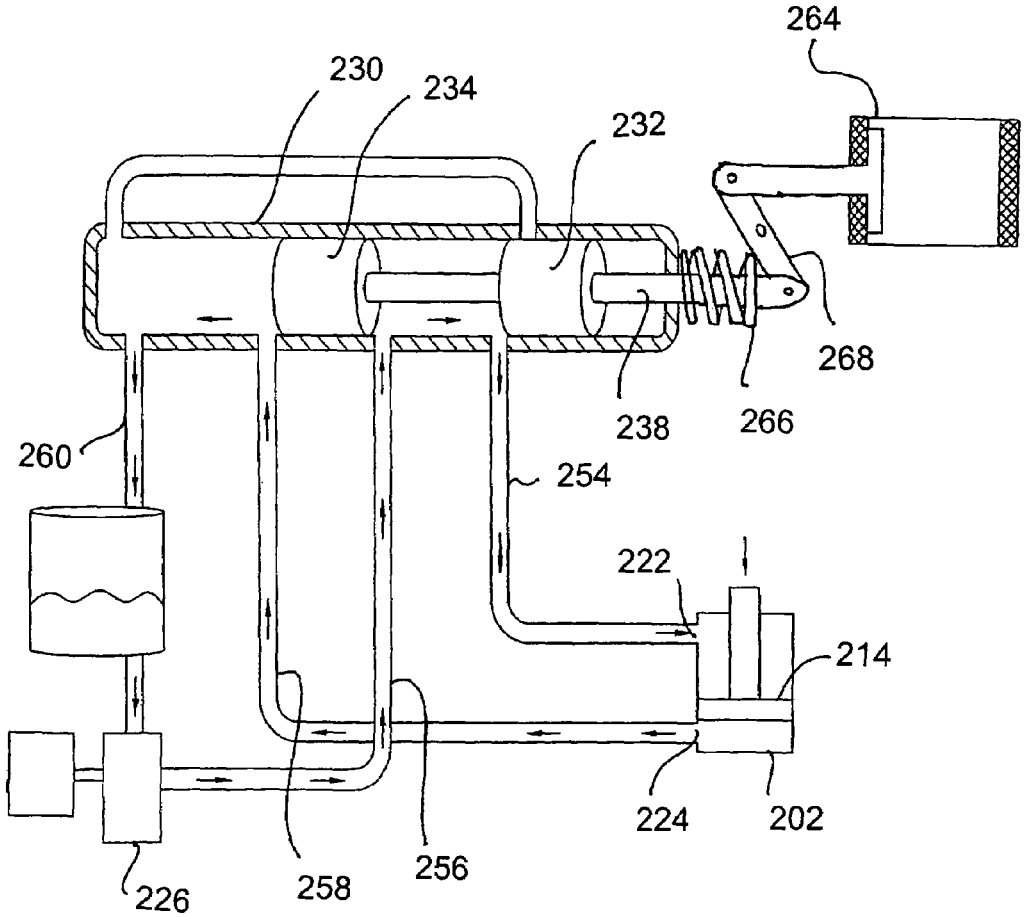
FIG. 15 is a schematic cross-sectional view showing the hydraulic controller that is operating to lower the massage bumps on the lifter.

FIGS. 13–15 schematically show the hydraulic controller 204. The hydraulic controller 204 includes a pump 226 that pressurizes hydraulic fluid, and a valve assembly 228 that selectively provides hydraulic fluid to the hydraulic actuator 202.

The valve assembly 228 includes a valve chamber 230, a first piston 232, a second piston 234, a valve conduit 236 and a valve rod 238. The first piston 232 and the second piston 234 are fixed to the valve rod 238 and move reciprocally in the valve chamber 230. The valve chamber 230 includes a first hole 240, a second hole 242, a third hole 244, a fourth hole 246, a fifth hole 248, a sixth hole 250 and a first rod hole 252. The valve rod 238 extends out of the valve chamber 230 through the first rod hole 252. The valve conduit 236 is positioned outside the valve chamber 230 and connects the fifth hole 248 and the sixth hole 250. The hydraulic controller 204 further includes a first conduit 254 that connects the first hole 240 of the valve chamber 230 and the upper hole 222 of the hydraulic actuator 202, a second conduit 256 that connects the pump 226 and the second hole 242 of the valve chamber 230, a third conduit 258 that connects the third hole 244 of the valve chamber 230 and the lower hole 224 of the hydraulic actuator 202, a fourth conduit 260 that connects the fourth hole 246 and the pump 226.

The hydraulic controller 204 may further include a hydraulic fluid accumulator 262 between the pump 226 and the valve assembly 228. The hydraulic fluid accumulator 262 stores pressurized hydraulic fluid.

As shown in FIG. 13, when the top plate 120 is lifted, the first piston 232 and the second piston 234 are moved to a lifting position in which the first piston 232 and the second piston 234 partition the valve chamber 230 such that hydraulic fluid flows from the pump 226 to the lower hole 224 of the hydraulic actuator 202 via the second conduit 256 and the third conduit 258 so that the plunger 214 is pushed upward, and hydraulic fluid flows from the upper hole 222 of the hydraulic actuator 202 to the pump 226 via the first conduit 254, the valve conduit 236, and the fourth conduit 260 so that hydraulic fluid is recovered.

As shown in FIG. 15, when the top plate is lowered, the first piston 232 and the second piston 234 are moved to a lowering position in which the first piston 232 and the second piston 234 partition the valve chamber 230 such that hydraulic fluid flows from the pump 226 to the upper hole 222 of the hydraulic actuator 202 via the first conduit 254 and the second conduit 256 so that the plunger 214 is pushed downward, and hydraulic fluid flows from the lower hole 224 of the hydraulic actuator 202 to the pump 226 via the third conduit 258 and the fourth conduit 260 so that hydraulic fluid is recovered.

As shown in FIG. 14, when the top plate is neither lifted nor lowered, the first piston 232 and the second piston 234 are moved a neutral position in which the first piston 232 and the second piston 234 block the first hole 240 and the third hole 244 such that hydraulic fluid flow between the hydraulic controller 204 and the hydraulic actuator 202 does not occur.

The hydraulic controller 204 further includes a first solenoid 264 that applies force to move the valve rod 238 of the valve assembly 228 into or out of the valve chamber 230 such that the first piston 232 and the second piston 234 are moved to the lifting position or the lowering position, and a first spring 266 fixed between the first solenoid 264 and the valve chamber 230 to return the first piston 232 and the second piston 234 to the neutral position when no force is applied by the first solenoid 264.

In this way, the hydraulic controller 204 provides precise control of the vertical motion of the top plate 120 with the hydraulic actuator 202.

The hydraulic controller may further include a link 268 connected between the valve rod 238 and the first solenoid 264. The link 268 reverses direction of movement of the first solenoid 264, and the first spring 266 is fixed between the valve chamber 230 and the link 268.

As shown in FIG. 14, The hydraulic controller may further include a second solenoid 270 and a second spring 272 that are similar to the first solenoid 264 and the second spring 272 at a position opposite to that of the first solenoid 264. The valve chamber 230 further includes a second rod hole 274 that is opposite to the first rod hole 252, and the valve rod 238 extends out of the valve chamber 230 through the second rod hole 274. The two solenoids provides balanced movement of the valve rod 238.

Referring back to FIG. 3, elongated guides 62 downwardly extend from the bottom lower surface portion 136 of the lifter 20, and guide bushes 64 are upwardly formed on the rider 18 to releasably receive the elongated guides 62 so as to stabilize the roller coasting movement of the lifter 20 along the roller coasters 50. Preferably, the elongated guides 62 are shaped in pins.

Referring back to FIG. 7, two side coasting walls 156 extend downward from two opposing ends of the bottom plate 122, and the coaster guide rollers 90 are rotatably attached to the side coasting walls 156.

In order to finally apply the gear-operated link lifting mechanism to a patient lying on the massager 10, there are provided massage bumps 100 attached to the top upper surface portion 205 of the lifter 20 and moving vertically and/or horizontally along the elongated top opening 16 of the elongated top panel 14 of the base frame 12. Optionally, a pad 17 may be provided to cover the massage bumps 100 and the elongated top opening 16 of the base frame 12.

The massage bumps 100 are preferably partitioned to first and second pairs 102, 104. Here, the first pair bumps 102 are aligned parallel to the second pair bumps 104. The massage bumps 100 each include a heater 106 which can be a heating lamp generating heat and infrared rays.

To further improve massaging effect, there are provided first and second bump holders 108, 110 propping and maintaining the first and second pair bumps 102, 104 above the top plate 120 of the lifter 20. For a better massaging result, the first and second bump holders 108, 110 are tapered toward each lower end 109 thereof, and a first engagement member 112 to rockingly engage the lower ends 109 of the bump holders 108, 110 to the top plate 120 of the lifter 20, and a second engagement member 116 to rollingly engage the massage bumps 100 thereto, are provided. The massage bumps 100 may be roller balls formed of precious stone such as jade.

FIG. 9 shows that the top plate 120 is in its uppermost position, that is, the massage bumps 100 are in their topmost position. FIG. 8 shows that the top plate 120 is in its lowermost position, that is, the massage bumps 100 are in their lowermost position.

Figure 12:
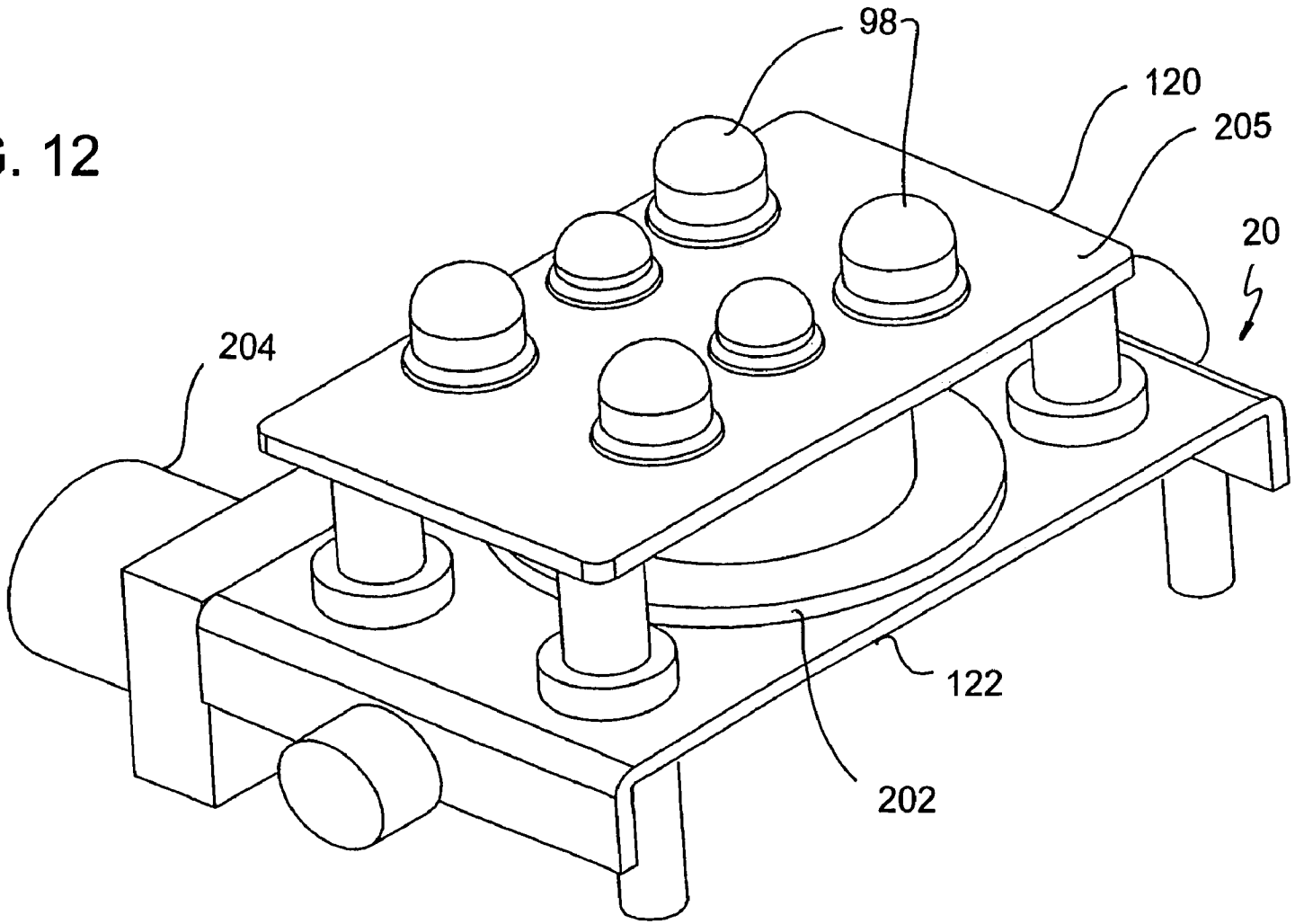
FIG. 12 is a perspective view of the lifter with different massage bumps attached thereon.

FIG. 12 shows alternate massage bumps 98. The massage bumps 98 are round projections that are fixed to the top upper surface portion 205 of the lifter 20.

Although the invention has been described in considerable detail, other versions are possible by converting the aforementioned construction. Therefore, the scope of the invention shall not be limited by the specification specified above.

What is claimed is:

1. A lie-down massager, comprising:

a) a base frame having an elongated top panel, wherein an elongated top opening is formed centrally and lengthwise through the elongated top panel;

b) a rider provided below the elongated top panel of the base frame;

c) a guide member movably engaged between the base frame and the rider so as to enable the rider to make a horizontally reciprocal movement relative to the base frame;

d) a lifter having a top plate and a bottom plate, a hydraulic actuator fixed to the bottom plate, and a hydraulic controller, wherein the hydraulic controller controls operation of the hydraulic actuator, wherein the top plate has a top upper surface portion and a top lower surface portion, wherein the bottom plate has a bottom upper surface portion and a bottom lower surface portion, wherein the hydraulic actuator has a hollow cylinder, a plunger reciprocating in the cylinder, and a shaft fixed to the plunger and the top plate;

e) one or more lifter guides extending downward from the top lower surface portion of the top plate;

f) one or more lifter guide bushes extending upward from the bottom upper surface portion of the bottom plate to releasably receive the lifter guides;

g) massage bumps attached to the top upper surface portion of the lifter and moving vertically and/or horizontally along the elongated top opening of the elongated top panel of the base frame; wherein the cylinder of the hydraulic actuator comprises a upper hole positioned near one end of the hydraulic actuator that is directed toward the top plate of the lifter, and a lower hole positioned near the other end of the hydraulic actuator, wherein the hydraulic controller supplies hydraulic fluid to the cylinder via the lower hole and recovers hydraulic fluid via the upper hole when the hydraulic actuator lifts the top plate, and wherein the hydraulic controller supplies hydraulic fluid to the cylinder via the upper hole and recovers hydraulic fluid via the lower hole when the hydraulic actuator lowers the top plate;

h) wherein the hydraulic controller comprises a pump that pressurizes hydraulic fluid, and a valve assembly that selectively provides hydraulic fluid to the hydraulic actuator; wherein the valve assembly comprises a valve chamber, a first piston, a second piston, a valve conduit and a valve rod, wherein the first piston and the second piston are fixed to the valve rod and move reciprocally in the valve chamber, wherein the valve chamber comprises a first hole, a second hole, a third hole, a fourth hole, a fifth hole, a sixth hole and a first rod hole, wherein the valve rod extends out the valve chamber through the first rod hole, wherein the valve conduit is positioned outside the valve chamber and connects the fifth hole and the sixth hole, wherein the hydraulic controller further comprises a first conduit that connects the first hole of the valve chamber and the upper hole of the hydraulic actuator, a second conduit that connects the pump and the second hole of the valve chamber, a third conduit that connects the third hole of the valve chamber and the lower hole of the hydraulic actuator, a fourth conduit that connects the fourth hole and the pump, wherein when the top plate is lifted, the first piston and the second piston are moved to a lifting position in which the first piston and the second piston partition the valve chamber such that hydraulic fluid flows from the pump to the lower hole of the hydraulic actuator via the second conduit and the third conduit so that the plunger is pushed upward, and hydraulic fluid flows from the upper hole of the hydraulic actuator to the pump via the first conduit, the valve conduit, and the fourth conduit so that hydraulic fluid is recovered, wherein when the top plate is lowered, the first piston and the second piston are moved to a lowering position in which the first piston and the second piston partition the valve chamber such that hydraulic fluid flows from the pump to the upper hole of the hydraulic actuator via the first conduit and the second conduit so that the plunger is pushed downward, and hydraulic fluid flows from the lower hole of the hydraulic actuator to the pump via the third conduit and the fourth conduit so that hydraulic fluid is recovered, wherein when the top plate is neither lifted nor lowered, the first piston and the second piston are moved a neutral position in which the first piston and the second piston block the first hole and the third hole such that hydraulic fluid flow between the hydraulic controller and the hydraulic actuator does not occur.

2. The lie-down massager of claim 1 further comprising a pad covering the massage bumps and the elongated top opening of the base frame.

3. The lie-down massager of claim 1 wherein the massage bumps are partitioned to first and second pairs, wherein the first pair bumps are aligned parallel to the second pair bumps.

4. The lie-down massager of claim 3 further comprising:

a) first and second bump holders propping and maintaining the first and second pair bumps above the top plate of the lifter, wherein the first and second bump holders are tapered toward each lower end thereof; and b) a first engagement member to rockingly engage the lower ends of the bump holders to the top plate of the lifter.

5. The lie-down massager of claim 4 further comprising a second engagement member to rollingly engage the massage bumps thereto.

6. The lie-down massager of claim 4 wherein the massage bumps are roller balls.

7. The lie-down massager of claim 6 wherein the roller balls are formed of jade.

8. The lie-down massager of claim 1 wherein each of the massage bumps includes a heater.

9. The lie-down massager of claim 8 wherein the heater is a heating lamp generating heat and infrared rays.

10. The lie-down massager of claim 1 wherein the guide member comprises:

a) one or more roller gear engaged to and powered by a roller gear motor, wherein the roller gear motor is fixed to the rider; and b) one or more side rack gears parallel to each other and provided lengthwise in the base frame;

wherein the roller gears are rollably connected to the rider and rotatably mounted on the side rack gears.

11. The lie-down massager of claim 1 wherein the guide member comprises:

a) rider guide rollers provided on each side of the rider, wherein the rider guide rollers are rollably engaged to the base frame to guide a horizontally reciprocal movement of the rider;

b) a pair of pulleys linked by a rope and respectively mounted in a front end portion and a rear end portion of the base frame, wherein a predetermined portion of the rope is fixedly attached to the rider so that the pulley rotation enables the rider to generate a horizontally reciprocal movement of the rider.

12. The lie-down massager of claim 11 wherein the pulleys are relatively twisted by 90 degrees against each other.

13. The lie-down massager of claim 1 further comprising:

a) a pair of roller coasters parallel to each other, wherein the roller coasters are attached to the base frame, wherein each of the roller coasters has a substantially waved top surface; and b) coaster guide rollers formed outwardly extending from each side of the lifter, wherein the coaster guide rollers enable the lifter to make a roller coasting movement on and along the waved top surfaces of the roller coasters.

14. The lie-down massager of claim 13 wherein each of the waved top surfaces of the roller coasters substantially forms a curvature of a human spinal cord.

15. The lie-down massager of claim 13 wherein the lifter further comprises a plurality of elongated guides extending downward from the bottom lower surface portion of the bottom plate, and the rider further comprises a plurality of guide bushes upwardly formed on the rider to releasably receive the elongated guides so as to stabilize the roller coasting movement of the lifter along the roller coasters.

16. The lie-down massager of claim 15 wherein the elongated guides are shaped in pins.

17. The lie-down massager of claim 1 wherein the hydraulic controller further comprises a hydraulic fluid accumulator between the pump and the valve assembly, wherein the hydraulic fluid accumulator stores pressurized hydraulic fluid.

18. The lie-down massager of claim 1 wherein the hydraulic controller further comprises a first solenoid that applies force to move the valve rod of the valve assembly into or out of the valve chamber such that the first piston and the second piston are moved to the lifting position or the lowering position, and a first spring fixed between the first solenoid and the valve chamber to return the first piston and the second piston to the neutral position when no force is applied by the first solenoid.

19. The lie-down massager of claim 18 wherein the hydraulic controller further comprises a link connected between the valve rod and the first solenoid, wherein the link reverses direction of movement of the first solenoid, and the first spring is fixed between the valve chamber and the link.

20. The lie-down massager of claim 18 wherein the hydraulic controller further comprises a second solenoid that applies force to move the valve rod of the valve assembly into or out of the valve chamber such that the first piston and the second piston are moved to the lifting position or the lowering position, and a second spring fixed between the second solenoid and the valve chamber to return the first piston and the second piston to the neutral position when no force is applied by the first solenoid, wherein the valve chamber further includes a second rod hole that is opposite to the first rod hole, and the valve rod extends out of the valve chamber through the second rod hole.

* * * * *